US007427704B2

(12) United States Patent
Huwaldt

(10) Patent No.: US 7,427,704 B2
(45) Date of Patent: Sep. 23, 2008

(54) STRINGED INSTRUMENT FINGERING GUIDE

(76) Inventor: David A. Huwaldt, 625 Cerro Vista Cir., Arroyo Grande, CA (US) 93420

( * ) Notice: Subject to any disclaimer, the term of this patent is extended or adjusted under 35 U.S.C. 154(b) by 71 days.

(21) Appl. No.: 10/939,060

(22) Filed: Sep. 9, 2004

(65) Prior Publication Data

US 2006/0048628 A1 Mar. 9, 2006

(51) Int. Cl.
*G10D 10/08* (2006.01)

(52) U.S. Cl. ..... 84/314 R; 84/470 R

(58) Field of Classification Search ..... 84/314 R, 84/470 R, 290; D17/20, 14, 18, 99; D19/59
See application file for complete search history.

(56) References Cited

U.S. PATENT DOCUMENTS

| | | | | |
|---|---|---|---|---|
| 1,556,147 | A | 10/1925 | Johnson et al. | |
| 1,821,516 | A | 9/1931 | Hohn | |
| 3,403,591 | A | 10/1968 | Weitzner | |
| 3,845,686 | A | 11/1974 | Salvo | |
| 3,854,370 | A | 12/1974 | Sapinski | |
| 3,916,753 | A * | 11/1975 | Smith | 84/267 |
| 3,943,815 | A | 3/1976 | Gilbert | |
| 4,080,867 | A | 3/1978 | Ratanangsu | |
| 4,132,143 | A * | 1/1979 | Stone | 84/314 R |
| 4,286,495 | A | 9/1981 | Roof | |
| 4,791,848 | A | 12/1988 | Blum, Jr. | |
| 4,807,509 | A | 2/1989 | Graham | |
| 4,901,618 | A | 2/1990 | Blum, Jr. | |
| 4,915,005 | A | 4/1990 | Shaffer | |
| 5,408,914 | A | 4/1995 | Breitweiser, Jr. et al. | |
| 5,458,040 | A | 10/1995 | Lawrence, Jr. | |
| 5,481,956 | A * | 1/1996 | LoJacono et al. | 84/314 N |
| 5,540,133 | A | 7/1996 | Draper et al. | |
| 5,576,505 | A | 11/1996 | Linhart | |
| 5,631,432 | A * | 5/1997 | Muncy | 84/293 |
| 5,796,025 | A | 8/1998 | Haake | |
| 5,920,023 | A | 7/1999 | Ravagni | |
| 5,929,362 | A | 7/1999 | Oteyza | |
| 6,156,961 | A * | 12/2000 | Beckmeier | 84/293 |
| 6,162,981 | A | 12/2000 | Newcomer et al. | |

(Continued)

FOREIGN PATENT DOCUMENTS

TW 223215 B1 * 11/2004

OTHER PUBLICATIONS

PCT International Search Report and Written Opinion of the International Searching authority, PCT/US05/32306, mailing date Feb. 16, 2007.

*Primary Examiner*—Lincoln Donovan
*Assistant Examiner*—Jianchun Qin
(74) *Attorney, Agent, or Firm*—Thomas F. Lebens; Sinsheimer Juhnke Lebens & McIvor, LLP

(57) ABSTRACT

A finger guide plate includes a fret plate; a circuit board coupled to a bottom of the fret plate; and a support plate including fret relief notches coupled to a bottom of the circuit board. A learning apparatus for a stringed instrument includes a replacement fret board designed to rest between an existing fret board and a plurality of strings of the stringed instrument; a controlling mechanism for controlling an indicator coupled to the replacement fret board; wherein the indicator displays which of the plurality of strings of the stringed instrument is to be played.

23 Claims, 16 Drawing Sheets

U.S. PATENT DOCUMENTS

| | | | | |
|---|---|---|---|---|
| 6,191,348 | B1 | 2/2001 | Johnson | |
| 6,218,603 | B1 | 4/2001 | Coonce | |
| 6,225,544 | B1 | 5/2001 | Sciortino | |
| 6,239,344 | B1 | 5/2001 | Prevost | |
| 6,452,080 | B1 | 9/2002 | Coonce | |
| 6,452,081 | B1 | 9/2002 | Ravagni | |
| 6,462,259 | B1 * | 10/2002 | Chapman | 84/314 N |
| 6,483,018 | B2 | 11/2002 | Mead | |
| 2002/0020282 | A1 * | 2/2002 | Tamura | 84/743 |
| 2005/0126365 | A1 * | 6/2005 | Shaffer | 84/314 R |

* cited by examiner

STRINGED INSTRUMENT FINGERING GUIDE

BACKGROUND OF THE INVENTION

1. Field of the Invention

The present invention relates generally to stringed instruments. Even more specifically, the present invention relates to an apparatus to aid in the playing of a stringed instrument.

2. Discussion of the Related Art

Learning aids for stringed instruments have been designed, however, they have problems with their effectiveness, cost, portability and diversity. One solution places a first group of visual indicators mounted on the neck of a fret board, where each indicator is immediately beneath and in registry with a particular string and fret of the instrument so as to identify therewith. This design has a great drawback as the instrument will generally be more expensive than many very high end guitars. A person just learning to play the guitar will generally not want to make such a large investment.

Another solution comprises a sheet of autogenously adhesive plastic, such as cling vinyl, with a thin stiff backing board, within which is a set of dynamically operated markers such as LED lamps. The flexible nature of the backing board can easily cause the LED's to fail. Additionally, the cling vinyl can become easily tangled rendering the aid unusable or stretch causing the indicator position to be incorrect.

Thus, a learning aid which overcomes these and other problems and disadvantages is needed.

SUMMARY OF THE INVENTION

The present invention advantageously addresses the needs above as well as other needs by providing a learning aid for a stringed instrument.

One embodiment includes an apparatus for a stringed instrument comprising a replacement fret board comprising a fret plate including an overlapping nut; and a support board including fret relief notches coupled to the fret plate; and an attachment member coupled to the replacement fret board for securing the fret board device to the stringed instrument.

Another embodiment can be characterized as a finger guide plate comprising a fret plate; a circuit board coupled to a bottom of the fret plate; and a support plate including fret relief notches coupled to a bottom of the circuit board.

One alternative embodiment can include a learning apparatus for a stringed instrument comprising a replacement fret board designed to rest between an existing fret board and a plurality of strings of the stringed instrument; means for controlling an indicator coupled to the replacement fret board; wherein said indicator displays which of the plurality of strings of the stringed instrument is to be played.

Yet another embodiment can be characterized as a finger guide plate comprising a fret plate including an overlapping nut; a circuit board coupled to the fret plate; and means for indicating strings to be played on a stringed instrument.

Still another embodiment includes a replacement fret board comprising a replacement nut; a fret plate coupled to the replacement nut; and an overlapping nut slider coupled to the fret plate.

BRIEF DESCRIPTION OF THE DRAWINGS

The above and other aspects, features and advantages of the present invention will be more apparent from the following more particular description thereof, presented in conjunction with the following drawings wherein.

Figure 1:
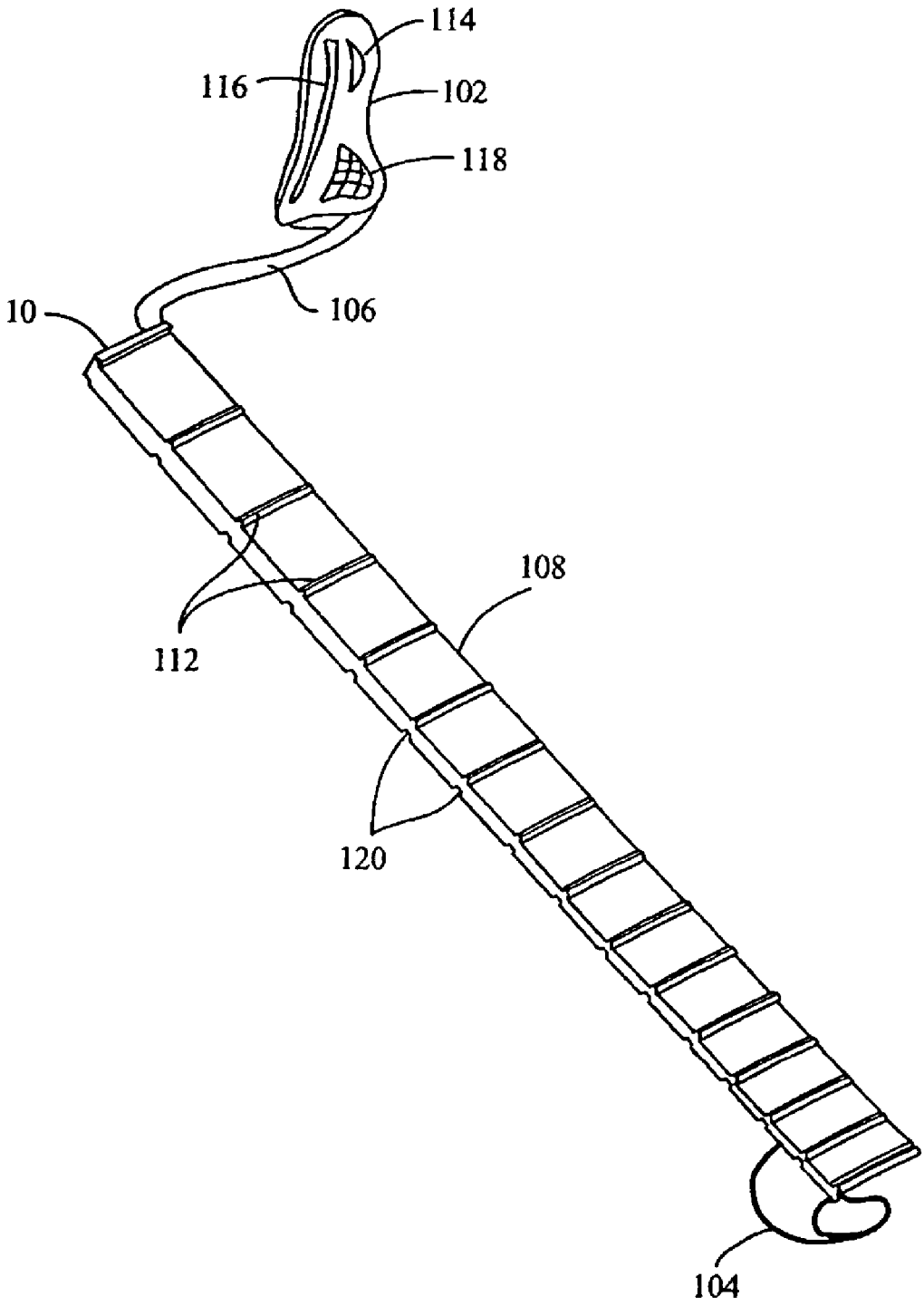
FIG. 1 is an isometric diagram illustrating a learning aid in accordance with an embodiment.

Corresponding reference characters indicate corresponding components throughout the several views of the drawings. Skilled artisans will appreciate that elements in the figures are illustrated for simplicity and clarity and have not necessarily been drawn to scale. For example, the dimensions, sizing, and/or relative placement of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. It will also be understood that the terms and expressions used herein have the ordinary meaning as is usually accorded to such terms and expressions by those skilled in the corresponding respective areas of inquiry and study except where other specific meanings have otherwise been set forth herein.

DETAILED DESCRIPTION

The following description is not to be taken in a limiting sense, but is made merely for the purpose of describing the general principles of the invention. The scope of the invention should be determined with reference to the claims.

Referring to FIG. 1, an isometric diagram is shown illustrating a learning aid in accordance with one embodiment of the present invention. Shown is a control unit 102, an attachment clasp 104, a communication channel 106, a replacement fret board 108, an overlapping nut 110, a plurality of replacement frets 112, a plurality of fret reliefs 120, input control switches 114, scale keys 116 and mode keys 118. The learning aid in operation will preferably be attached to a stringed instrument (not shown).

Figure 12:
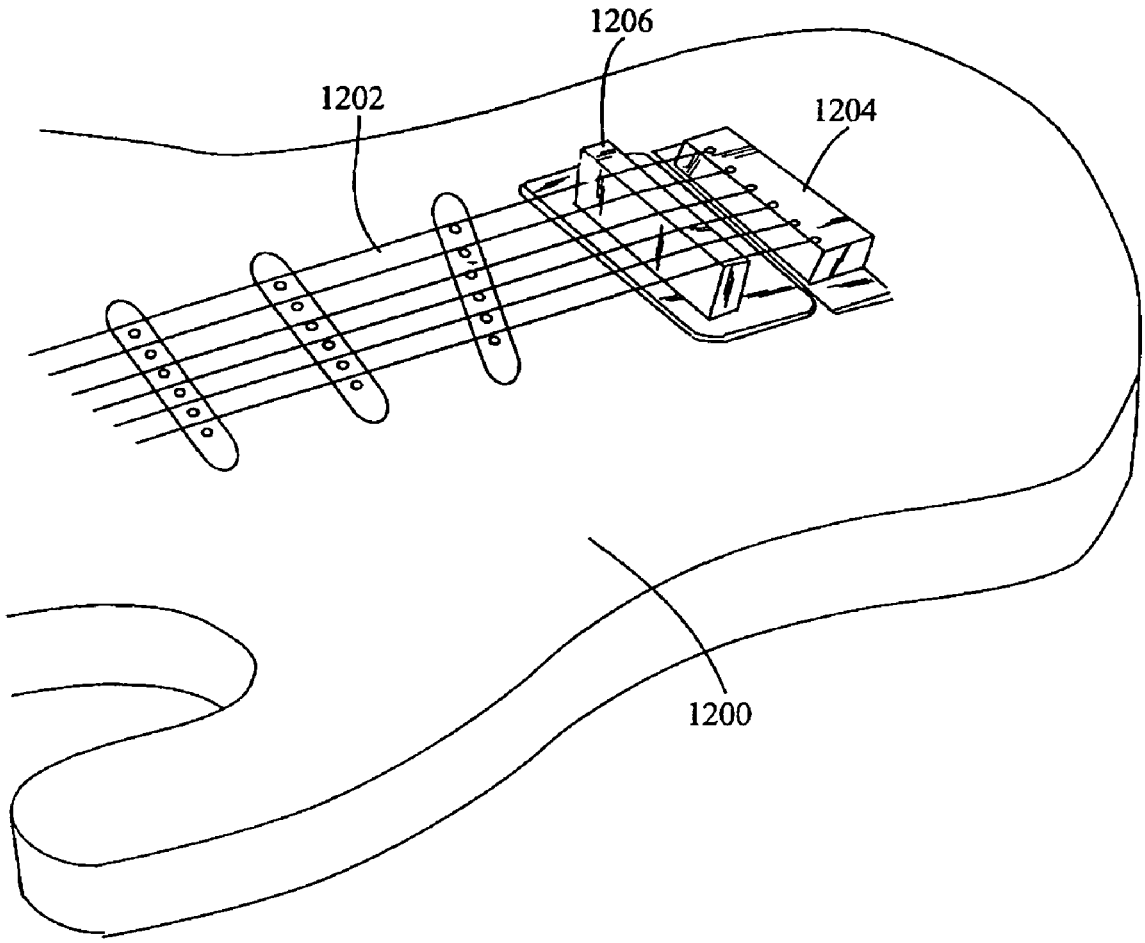
FIG. 12 is an isometric diagram illustrating a replacement bridge on a stringed instrument in accordance with an embodiment.
Figure 13:
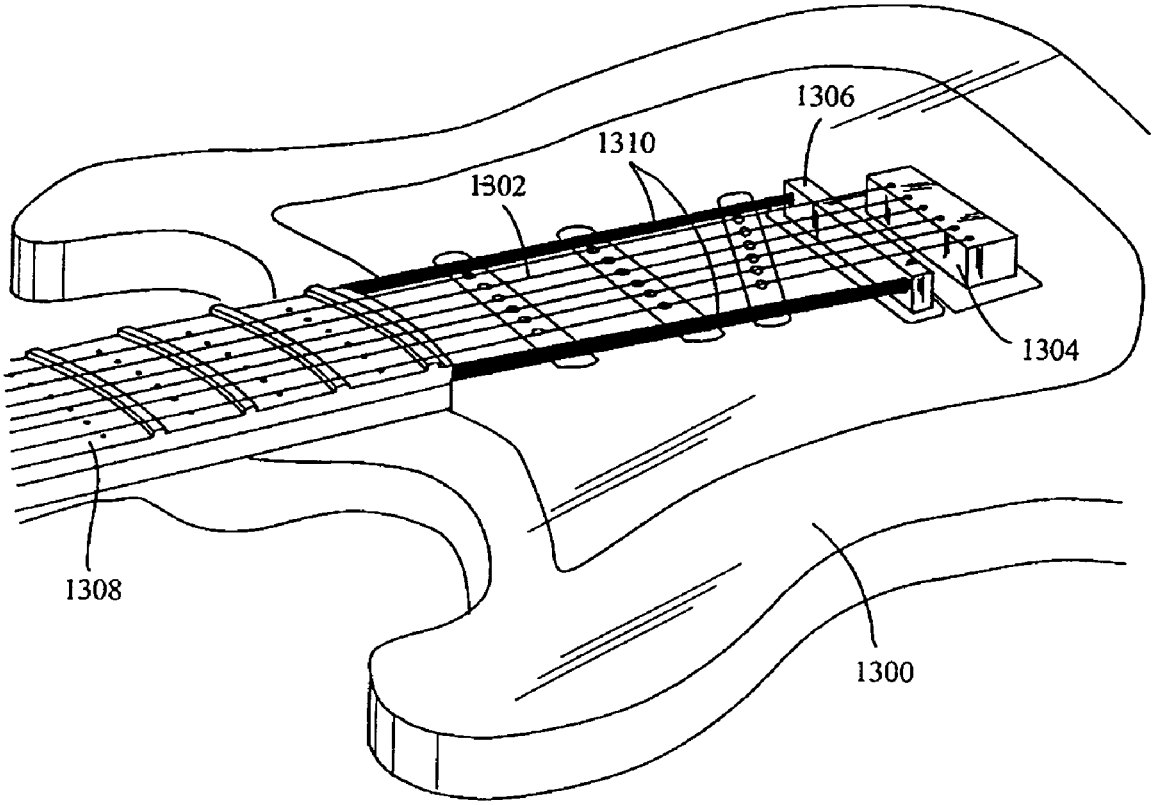
FIG. 13 is an isometric diagram illustrating another replacement bridge on a stringed instrument in accordance with an alternative embodiment.

The control unit 102 is electrically coupled to the replacement fret board 108 through the communication channel 106. The replacement fret board 108 is also coupled to the attachment clasp 104. The replacement fret board 108, also referred to herein as a replacement fret board, is shown with a tapered thickness. The end of the replacement fret board 108 nearest the control panel 102 is thicker than the end near the attachment clasp 106. In some of the embodiments described herein, having a tapered replacement fret board 108 will provide the strings of a stringed instrument with clearance of the replacement fret board 108 near the end with the attachment clasp 106. As shown in FIGS. 12 and 13, a replacement bridge optionally is utilized such that the replacement fret board 108 does not need to be tapered and will not interfere with the strings. Alternatively, the fret plate is designed to be thin enough that no tapering is needed. Another alternative is to provide a replacement fret board 108 that has the same width along the entire length, however, have fret reliefs 120 with greater depths near the end of the replacement fret board 108 with the attachment clasp 106. This will keep the replacement fret board 108 from interfering with the strings.

The learning aid of the present invention provides for a device that helps a person learn the correct placement of their fingers on the neck (fretted or non-fretted) of a stringed instrument and optionally aids in the strumming of the instrument. The device preferably has a plurality of indicators (shown, for example, in FIG. 4) that light up and show the user which strings on the instrument to be pressed and also where the strings on the instrument should be pressed. The strings are normally be pressed up against the neck of the stringed instrument and then strummed, however, when the learning aid is attached to a stringed instrument, the strings will be pressed against the learning aid.

Figure 4:
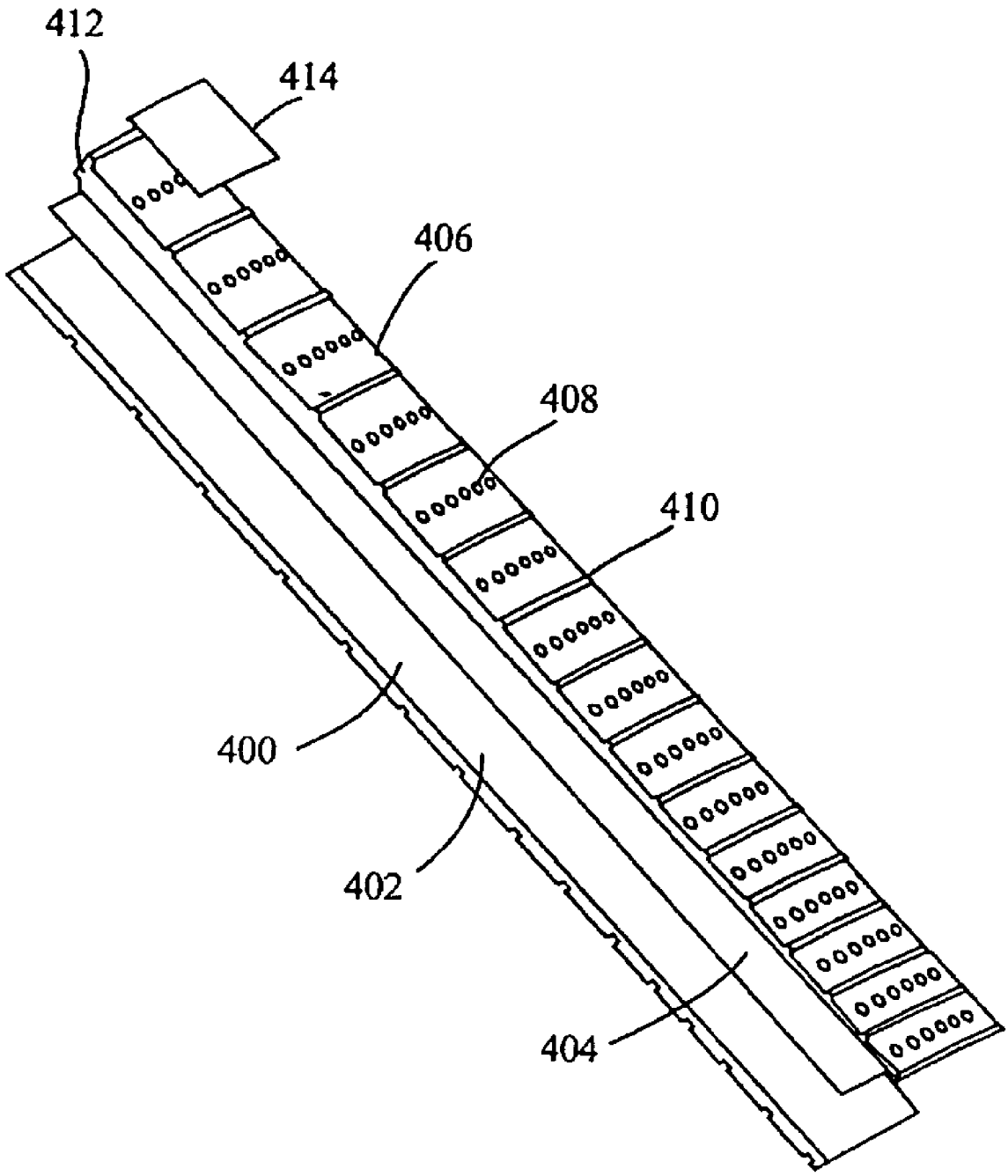
FIG. 4 is an isometric diagram illustrating a portion of the learning aid of FIG. 1 in accordance with an embodiment.

As is shown, the replacement fret board 108 has a plurality of frets 112, however, the replacement fret board 108 can be made without the frets 112. As is shown in FIG. 4, a plurality of indicators, e.g., light emitting diodes (LED's), are located along the replacement fret board 108. The LED's are preferably placed in rows in between the frets 112 of the replacement fret board 108. Alternatively, the LED's are placed in rows anywhere along the length of the replacement fret board 108 when there are no frets.

Optionally, a row of LED's is placed at the end of the replacement fret board 108 closest the body of the stringed instrument and indicate to a user which of the strings are to be strummed. In this manner, a LED associated with each string is placed at the end of the replacement fret board 108. The LED associated with each string light up only when that associated string is to be strummed. Alternatively, the LED associated with each string will only light up when a string is not to be strummed.

Generally, the LED's indicate those strings that are to be played by lighting up, however, the LED's alternatively indicate strings that are not going to be played by lighting up. In one embodiment, the LED's are Red/Green LED's where one of the two colors (e.g., red) will light up, thus indicating that the string is to be played, and the other color (e.g., green) will light up, thus indicating the strings not be played. Alternatively, the root notes of any give scale or chord are displayed using a different color or brightness in order to give the user a reference point. Therefore, many different color schemes or the LED brightness help a user in learning to play the stringed instrument.

In still another alternative, the LED's are bi-colored LED's (e.g., Red/Green LED's). In order to give the appearance of having more than only two colors available, the control unit 102 alternates very rapidly between the Red and Green color of the LED. Depending upon the length of time each color is on, the LED will give off an appearance of brown or amber. Advantageously, this allows for having more than two colors that can be displayed without having to add additional LED's to the learning aid. Having more than two colors available for display helps to further distinguish finger placement for a user of the learning aid.

In still another alternative, there are two LED's for each hole on each of the frets. For example, one green LED and one Red LED. By varying the brightness of the two LED (e.g., from off to max power) at least four different colors are achieved. This provides one color for each finger (excluding the thumb) that is used for playing notes such that the correct finger placement is indicated.

Additionally in one embodiment, in order to indicate a string that is not to be strummed, the lights for all of the frets associated with the string that is not to be strummed are lit. Any of the four different colors can be used.

The control unit 102 shown is but one embodiment of a control unit and other types of input switches and control options may be added or removed. Alternative control unit 102 design and placement will be described herein with reference to FIGS. 9-11 and 14-16. The control unit 102 shown attaches to a head of the stringed instrument, however, the control unit 102 is attached to other parts of the stringed instrument or is remote from the stringed instrument in alternative embodiments. When the control unit 102 is remote from the stringed instrument, preferably, the communication channel 106 is a wireless communication channel, however this is not required. The wireless communication channel is used to transmit, for example, a radio wave signal, a laser signal, a frequency modulated signal, a CDMA signal, a TDMA signal, or any other type of communication signal. When the communication channel 106 is a wireless channel, the replacement fret board 108 is equipped with a receiver such that the replacement fret board 108 can received commands from the control unit 102. The commands indicate to the receiver which LED's that are to light up and what color the LED should light (e.g., Red or Green).

The control unit 102 designed in one embodiment to allow for a chip, card, or memory stick to be inserted allowing new scales, chords, lead riffs, to de displayed. This allows for a user to easily change what is being played and allows for a user to increase the difficulty of what is being played as they progress without having to purchase a new learning aid or new control unit.

In one embodiment, the control unit 102 is implemented utilizing key inputs into a micro controller. The microcontroller controls a serial input LED driver. The serial input LED turns the LED's on or off. For example, in response to a sequence of key inputs, data is sent from the microcontroller to the LED driver. The LED driver then turns on one or more LED's. In one embodiment the microcontroller is a programmable interrupt controller (PIC). Optionally, the different variations for chords and scales are stored in charts or table of data. The key inputs then allow a user to select a mode (e.g., chord, scale, single note), select a key (e.g., A, B, C, D), and select a chord type (e.g., major, minor, sharp, flat, sus, dim).

The control unit 102 can be many different types of controlling mechanisms for the LED's. For example, in different embodiments, the control unit 102 includes a hard wired circuit, a micro-controller, a desktop computer, a personal digital assistant (PDA), a laptop, or many other types of control devices. In one embodiment, a computer with a wireless communication channel can be utilized to control the LED's. The learning aid can include an antenna for receiving the control signals. Advantageously, this provides for a large amount of flexibility in how the LED's are controlled as the computer has a lot of processing power. Optionally, new lead riffs or scale patterns are downloaded from a web-site or database. The controller utilizes the lead riffs or scale patterns to change the pattern of when the LED's light up. Advantageously, this provides a user with the ability to download and learn new material. This amount of processing power is very advantageous for a more advance user. As yet another option, the computer controls the LED's through a communication port, such as, a universal serial bus (USB). The control of the LED's is controlled through the use of a software program on the computer. The software program sends control signals over the communication port. The control signals are received at the learning device and utilized to turn on and off the LEDs. For example, the control signals are received at a LED driver that turns the LEDs on and off.

The replacement fret board 108 shown includes the overlapping nut 110, the plurality of replacement frets 112 and the plurality of fret reliefs 120. A more detailed view of one embodiment of the replacement fret board 108 is shown in FIG. 4. The overlapping nut 110 raises the strings of the stringed instrument and eliminates the need to keep the learning aid thin with respect to the frets of the stringed instrument. While, the learning aid can still be made relatively thin, this is no longer a constraint on the design. The learning aid optionally has a set of replacement frets 112 correctly sized relative to the new replacement fret board 108. Preferably, the replacement fret board 108 is thicker at the end having the overlapping nut 110 than at the end coupled to the attachment clasp 104. This prevents the strings of the instrument from contacting any of the plurality of replacement frets 120 on the replacement fret board 108 when the strings are not being pressed by a user and without any height adjustment to a bridge of the stringed instrument. In an alternative embodiment, the replacement fret board 108 is the same thickness throughout, however is thin enough such that the strings of the instrument are prevented from contacting any of the plurality of replacement frets 112 on the replacement fret board 108 without any adjustment to the bridge of the stringed instrument. In yet another embodiment, the bridge of an instrument is modified to accommodate the thickness of the replacement fret board 108 (shown in FIGS. 12 and 13).

The communication channel 106 comprises, in one embodiment, at least one electrically conductive wire coupling the control unit 102 to the circuit board within the replacement fret board 108. Optionally, the communication channel 106 is a communication bus, a wireless communication channel, a fiber optic channel or any other communication means known or to be developed through which control data for the LEDs is capable of being transferred.

The attachment clasp 104 is attached to the replacement fret board 108. The attachment clasp 104 can be made from a plastic material or a flexible metal. Additionally, alternative materials may be used. The attachment clasp 104 clips over the back of the neck of the stringed instrument and securely holds the replacement fret board 108 in place on the stringed instrument. Alternatively, the attachment clasp 104 is replaced by Velcro straps, elastic bands, or other attachment means. Preferably, the attachment means is designed to keep out of the way of both the front and back of the instrument so as not to interfere with the playing of the instrument. The attachment means optionally extends across the front side of the replacement fret board 108 so long as it does not interfere with the strings or the user's hand placement.

Advantageously, in preferred embodiments, the learning aid provides for a transportable, compact learning aid. Furthermore, the learning aid can be transportable between stringed instruments. The learning aid can also provide for the feel of a real stringed instrument, while providing controlled indicators on the replacement fret board. The learning aid can be used by people of all skill levels.

Optionally, the learning aid also includes a tuner, e.g., a digital tuner, such that the string tone can easily and properly be adjusted after attaching the learning aid to a stringed instrument.

Figure 2:
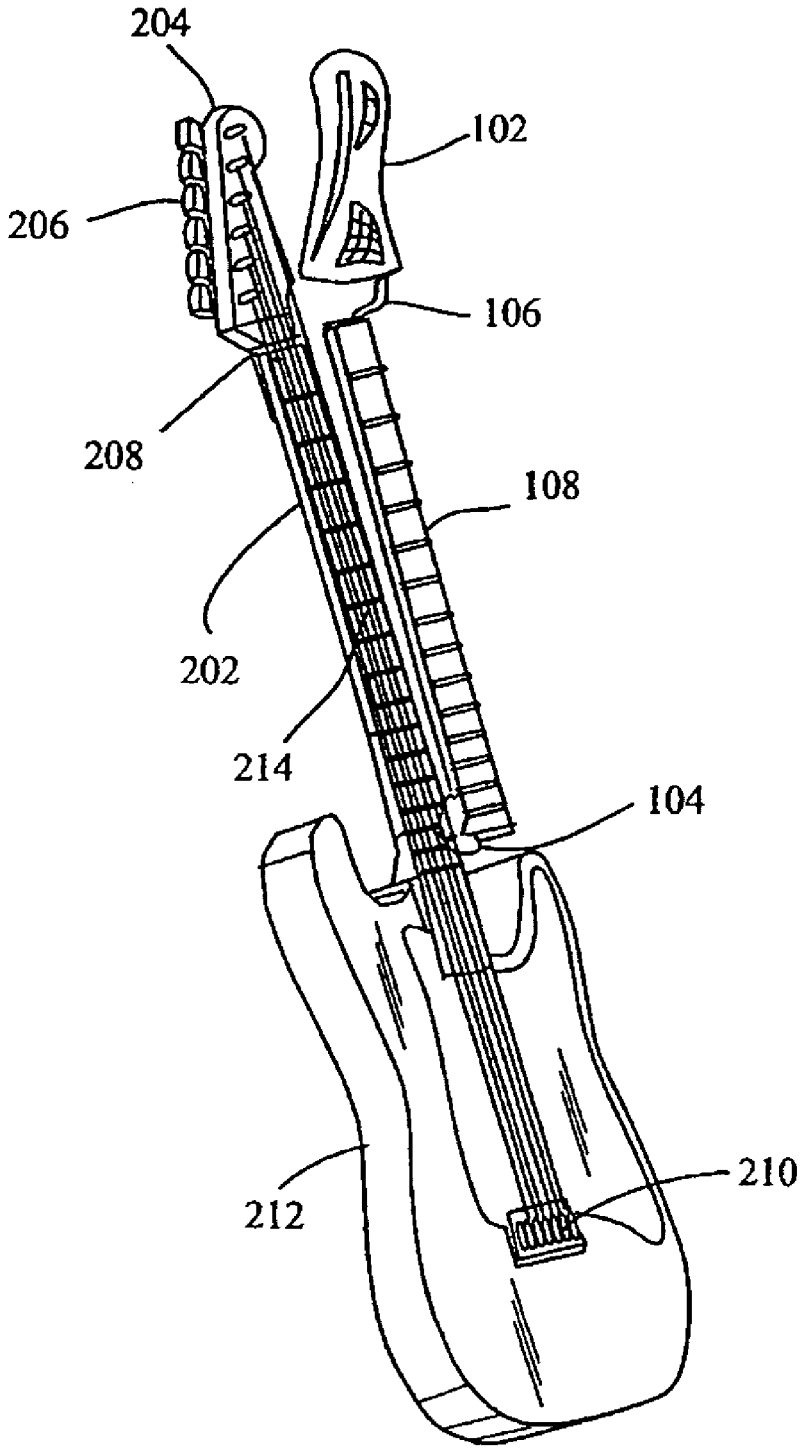
FIG. 2 is an isometric diagram illustrating a learning aid of FIG. 1 detached from a stringed instrument and in accordance with an embodiment.

Referring to FIG. 2, an isometric diagram is shown illustrating the learning aid of FIG. 1 detached from a stringed instrument in accordance with an embodiment of the present invention. Shown is a neck of the stringed instrument 202, a head of the stringed instrument 204, a plurality of tuning pegs 206, a nut 208, a bridge 210, a body of the stringed instrument 212, a plurality of strings 214, the control unit 102, the attachment clasp 104, the communication channel 106, and the replacement fret board 108. As is shown, the learning aid is shown detached from the stringed instrument.

The stringed instrument includes the head 204, the neck 202, the nut 208, the body 212, the plurality of tuning pegs 208, the bridge 210, and the plurality of strings 214. The learning aid includes the control unit 102, the communication channel 106, the replacement fret board 108, and the attachment clasp 104.

The stringed instrument includes both fretted and non-fretted instruments, such as, for example, a guitar (electric or acoustic), a banjo, a ukulele, a violin, a viola, and a cello.

To attach the learning aid to the stringed instrument, first, the plurality of strings are loosened (if they are on the stringed instrument). Next the replacement fret board 108 is placed over the neck 202 of the stringed instrument including the nut 208 of the stringed instrument. The control unit 102 is then coupled to the head of the stringed instrument. In an optional embodiment, the control unit 102 is remote from the replacement fret board 108 or is coupled to the neck 202 or body 212 of the stringed instrument. The plurality of strings 214 are then tightened back down on the overlapping nut 110 (shown in FIGS. 1 and 5) of the replacement fret board 108 and adjusted to be in tune accordingly. Optionally, the learning aid includes a tuner (e.g., a digital tuner) making it easy for a user of the learning aid to re-adjust the string tone after attaching the learning aid.

Figure 3:
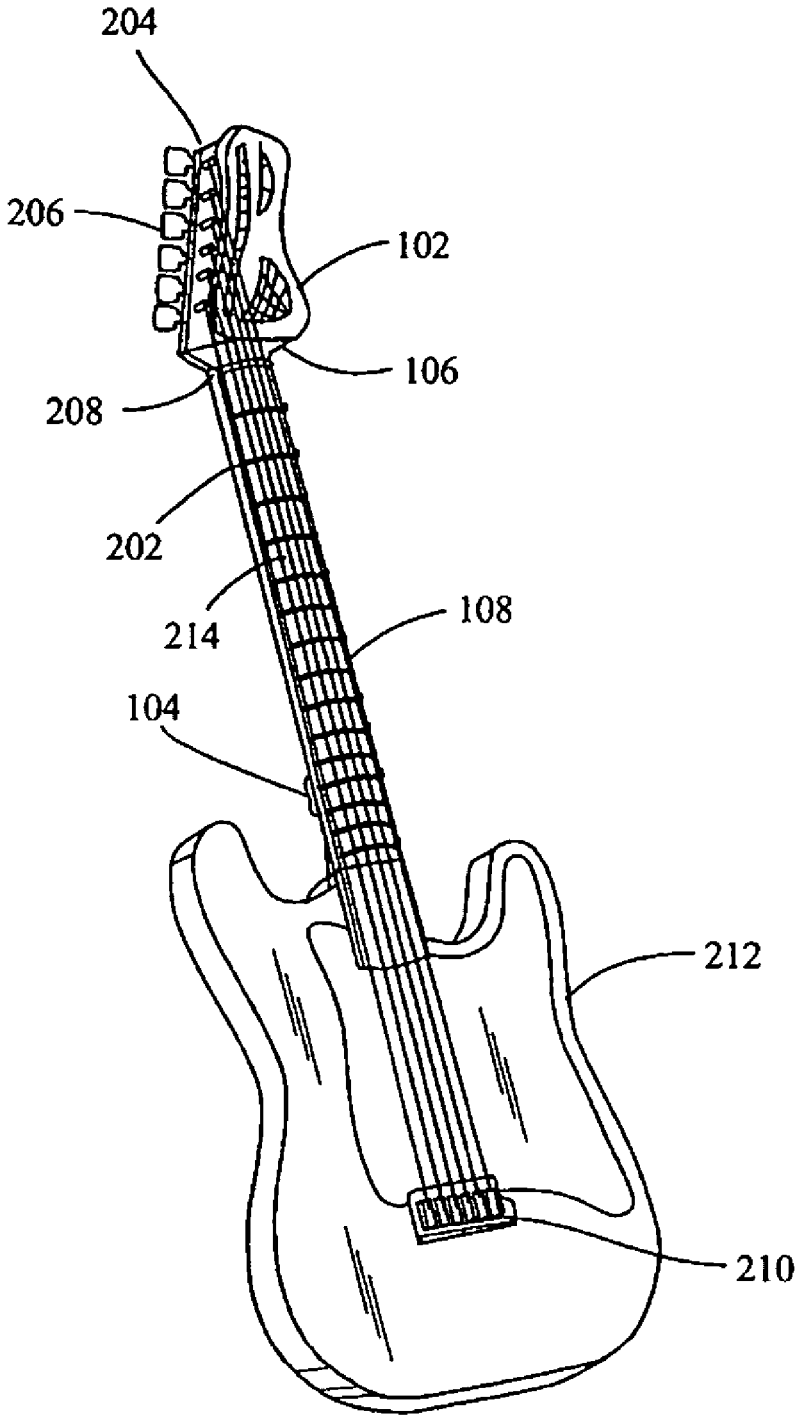
FIG. 3 is an isometric diagram illustrating the learning aid of FIG. 1 attached to a stringed instrument in accordance with one embodiment.

Referring to FIG. 3, an isometric diagram is shown illustrating the learning aid of FIG. 1 attached to the stringed instrument shown in FIG. 2 in accordance with an embodiment of the present invention. Shown is the neck of the stringed instrument 202, the head of the stringed instrument 204, the plurality of tuning pegs 206, the nut 208, the bridge 210, the body of the stringed instrument 212, the plurality of strings 214, the control unit 102, the attachment clasp 104, the communication channel 106, and the replacement fret board 108.

In the embodiment shown, both the control unit 102 and the replacement fret board 108 are detachably coupled to the stringed instrument. The control unit 102 is detachably coupled to the head 204 of the stringed instrument and the replacement fret board 108 is detachably coupled to the neck 202 of the stringed instrument. The replacement fret board 108 is placed in between the plurality of strings 214 and the neck 202 of the stringed instrument such that the replacement fret board 108 is at least partially held in place by the plurality of strings 214. Additionally, the replacement fret board 108 is also optionally held in place by the attachment clasp 104. The learning aid optionally provides for an improved learning tool for beginning users of, for example, a guitar. Additionally, the stringed instrument optionally provides for a learning aid which is used with existing instruments.

Advantageously, a beginning user of a stringed instrument does not have to purchase a specialized instrument with a built in learning aid. Such specialized instruments can be very expensive and thus not marketable to many beginners who do not want to make a large purchase before knowing if they will continue to try and develop their playing skills. In some embodiments, the learning aid is transferable between multiple stringed instruments with little or no adjustment of the learning aid needed.

Referring to FIG. 4, an isometric diagram is shown illustrating a portion of the learning aid of FIG. 1 in accordance with an embodiment of the present invention. Shown is a support plate 400, a plurality of fret reliefs 402 in the support plate, a circuit board 404, a fret plate 406, a plurality of holes 408 in the fret plate, a plurality of replacement frets 410, an overlapping nut 412, and a film covering 414.

The circuit board 404, in one embodiment, is either a Printed Circuit Board (PCB) or Flexible Printed Circuit (herein also referred to as Flex). As referred to herein, the PCB, the Flex and any other type of circuit board are a printed circuit. Preferably the circuit board (i.e., any type of printed circuit), or plurality of printed circuits (as will be described below) will have a plurality of LED's attached thereto. The LED's are preferably lined up with the plurality of holes 408 in the fret plate 406. In operation, the lights are controlled by a control circuit 102 (show in FIGS. 1 and 9-11) and guide a user of the stringed instrument as to which strings should be played. In this manner the LED's teach a user chords, scales, root note differentiation, on lead riffs. The LED's indicate either which strings should or should not be pressed along the fret board and alternatively indicate the strings that should or should not be strummed by the person playing the stringed instrument.

Still alternatively, the LED's and printed circuit 404 are replaced by a much few number of LED's or other light source (e.g., between one and five LED's, preferably one or two LED's) and a light pipe that reaches the plurality of hole locations (e.g., ninety locations for a 15 fret device). The light pipe is a clear plastic (e.g., polycarbonate or acrylic) piece that optically couples the light source to every hole in the fret board. A looped belt with holes is between the light pipe ends and the fret board. Holes in the belt allow light from the light pipe to pass through the belt and through the holes in the fret board. The light pipe can be a flexible mylar or stainless steel looped belt with a hole pattern in the form of a scale pattern. The belt loop is placed inside of the fret plate of the learning device and can have tractor feed holes along one or two edges. A rotating shaft with an attached gear will mesh with the tractor feed holds allowing the belt to shift position up and down the fret plate. This exposes the appropriate ends of the light pipe under the strings of the different frets located up and down the fret plate. In this manner scales are shown to the user of the learning aid.

The plurality of holes in the fret plate 408 are optionally covered by the film covering 414. The film covering 414 is one covering that covers the entire fret plate 406. Alternatively, the film covering 414 includes a plurality of film pieces that each cover only the holes between two of the replacement frets 410 on the fret plate 406. The film covering protects the holes from debris and also provides for an aesthetic look for the LED light and the fret plate 406. In yet another alternative, the plurality of film pieces each cover more than one set of the plurality of holes 408 in the fret plate 406.

The fret plate 406 includes the plurality of holes 408 and the plurality of replacement frets 410. The plurality of replacement frets 410 are not necessary for stringed instruments that do not have frets on the neck of the stringed instrument. The fret plate 406 can be made any number of different lengths for either the fretted or non-fretted stringed instruments. For example, the fret plate 406 can consist of five to seven frets (or corresponding length for a non-fretted instrument) making it less expensive for a beginning player. Optionally, the fret plate is capable of only showing chords. For the more advance player, the fret plate 406 consists of twelve to fifteen frets and is capable of showing cords, scales, patterns, and lead riffs.

In one embodiment, the bottom of the learning aid, e.g., the support plate 400, has a radius of curvature along the width of the learning aid. Many stringed instruments have a neck (with or without a fret board) that has a curvature along the width. Providing a radius of curvature to match the curvature of the neck of the stringed instrument allows for the learning aid to sit firmly against the stringed instrument and allows for more string clearance on the top of the learning aid. As will be described below, the circuit board 404, a plurality of circuit boards or a plurality of support plates make up the bottom of the learning aid and have a curvature that matches the curvature of the neck of the stringed instrument. In one embodiment, the learning aid can be rigid but flexible in order to conform to the radius of the neck of the stringed instrument. Optionally, the fret plate 406 is attached to the overlapping nut 412 so as to allow the fret plate to flex to conform to the neck of the stringed instrument. For example, the overlapping nut 412 is attached to the plate only at the midpoint or by a swivel.

In another embodiment, the support plate 400 does not include the fret reliefs 402. In this embodiment, the support plate 400 rest on the top of the frets of the stringed instrument. This design can be preferable if it desired to further raise the strings of the stringed instrument away from the fret board of the stringed instrument. The fret reliefs 402 are molded into on single support plate or optionally, the support plate 400 is a plurality of plates slightly spaced apart such that the space in between each of the support plates provides for the fret reliefs 404. Other designs optionally are utilized with a plurality of plates that each have one fret relief or that have a slightly recessed portion at an end that provides a fret relief 404.

Alternatively to having one circuit board 404, the learning aid incorporates a plurality of printed circuits that fit in between each of the frets of the stringed instrument. Advantageously, provides for a thinner design as the support plate 400 is optionally removed and the space in between each of the plurality of circuit boards is used as the fret reliefs 404. In one embodiment, there are 15 individual printed circuits, however, there can be more or less depending upon the desired size of the learning aid and/or the complexity of the learning aid. Additionally, a learning aid for non-fretted stringed instruments employ, in alternative embodiments any number of individual printed circuits. Optionally, the learning aid still includes the support plate (with or without fret reliefs) when utilizing a plurality of printed circuits. For example, each printed circuit has a support plate attached to it and the combination of the support plate and the circuit board provides the fret relief. Again, this provides for a thin design of the learning aid.

In one embodiment, the fret reliefs 404 are created wider than the frets on the stringed instrument. This allows for the learning aid to be transportable to different stringed instruments that have a slightly different spacing between the frets of the stringed instrument. Additionally, the depths of the fret reliefs 404 can be adjusted to provide for more or less relief along the length of the fret plate 406.

Figure 5:
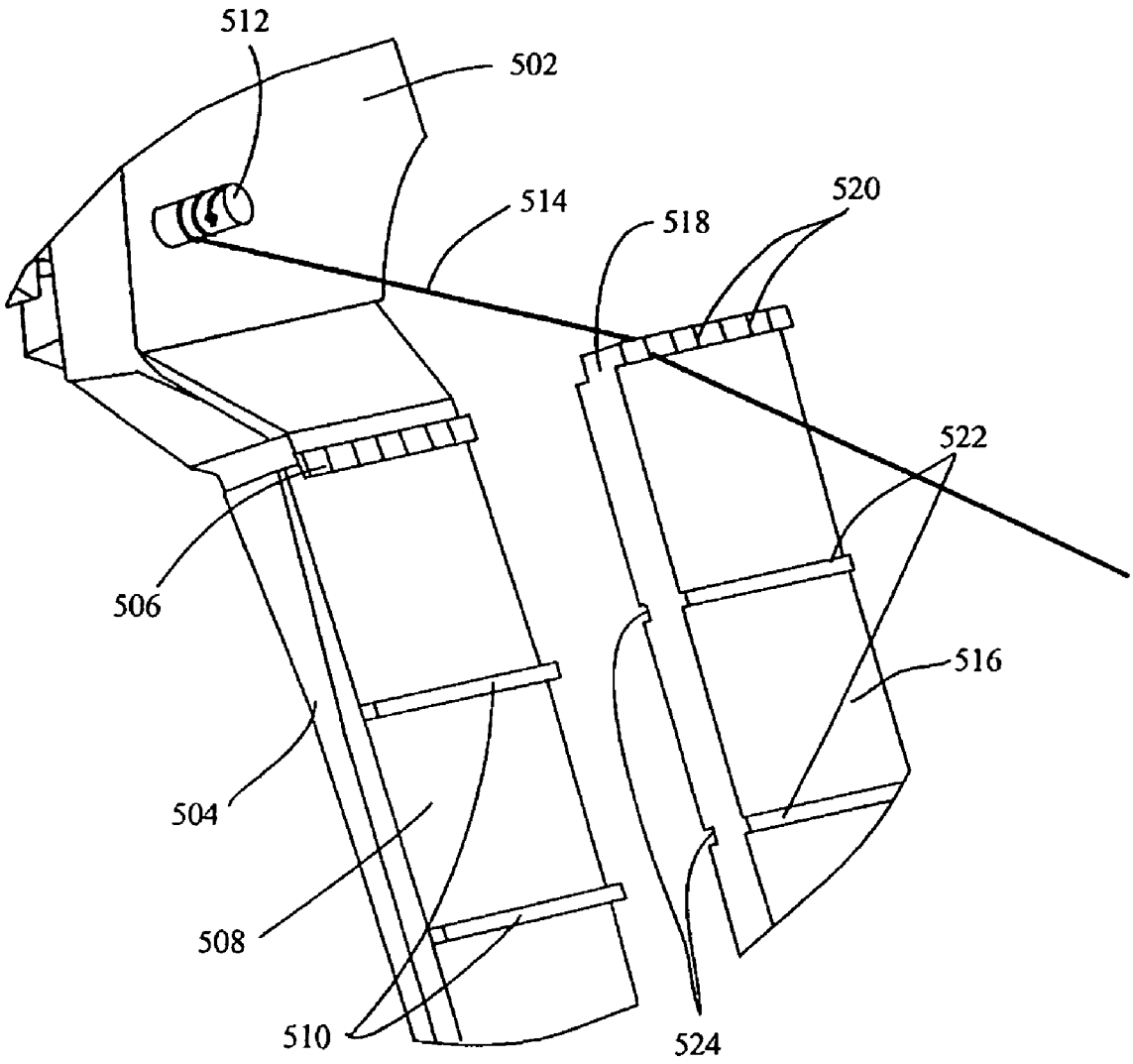
FIG. 5 is an isometric diagram illustrating a portion of the learning aid of FIG. 1 and a portion of a stringed instrument in accordance with an embodiment.

Referring to FIG. 5, an isometric diagram is shown illustrating a portion of the learning aid of FIG. 1 in accordance with an embodiment of the present invention. Shown is a head 502 of a stringed instrument, a neck 504 of the stringed instrument, a nut 506, a fret board 508, a plurality of frets 510, a tuning bolt 512, a string 514, a replacement fret board 516 of a learning aid, an overlapping nut 518, a plurality of string groves 520, replacement frets 522, and a plurality of fret reliefs 524.

As is shown, the replacement fret board 516 is not yet secured in place on the stringed instrument. In order to place the replacement fret board 516 on the stringed instrument, the strings (only one shown) are loosed and the replacement fret board 516 is placed between the replacement fret board 516 of the stringed instrument and the strings 514 of the stringed instrument. The overlapping nut replaces the nut of the stringed instrument and allows the stings 514 to be retuned with the learning aid in place.

The plurality of fret reliefs 524 allow the replacement fret board 516 to fit securely on the fret board 508 of the stringed instrument without elevating the replacement fret board 516. In some embodiments, the fret reliefs 524 are not desirable or needed and the bottom of the replacement fret board 516 is flat.

Figure 6:
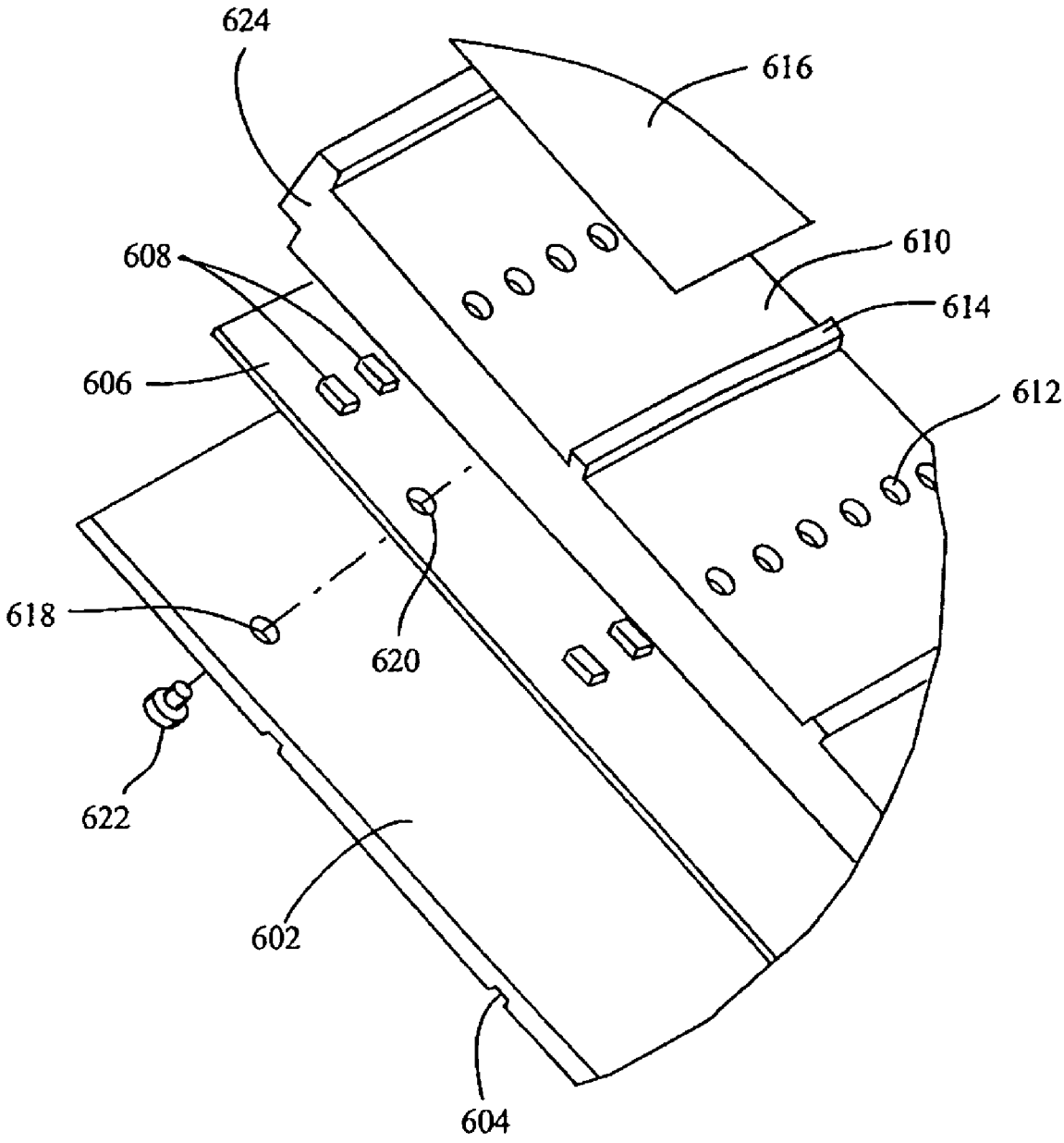
FIG. 6 is an isometric diagram illustrating an exploded portion of the learning aid of FIG. 1 in accordance with an embodiment.

Referring to FIG. 6, an isometric diagram is shown illustrating an exploded portion of the learning aid of FIG. 1 in accordance with an embodiment of the present invention. Shown is a support plate 602, a plurality of fret reliefs 604 in the support plate, a circuit board 606, a plurality of indicators 608, a fret plate 610, a plurality of holes 612 in the fret plate, a plurality of replacement frets 614, a film covering 616, a hole in the support plate 618, a hole in the circuit board 620, a screw 622 and an overlapping nut 624.

The diagram shows various parts of the learning aid separated so as to provide a more detailed view in accordance with one embodiment. The circuit board 606 and support plate 602 are attached to the fret plate 610 with a screw 622 that is placed through both the hole in the support plate 602 and the hole in the circuit board 606. This is but one means for fastening the support plate 602 and the circuit board 606 to the fret plate 610 and other fastening means are utilized in different embodiments. For example, the support plate 602 and the circuit board 606 can be fastened to the fret plate 610 with an adhesive.

The plurality of indicators 608, e.g., LED's, line up with the plurality of holes 612 in the fret plate 610. Thus, when one or more of the indicators 608 is turned on, the light from the indicator 608 will pass up through the hole 612 and through the film covering 616. This indicates to a user of the learning aid which strings are to be played on the stringed instrument.

Figure 7:
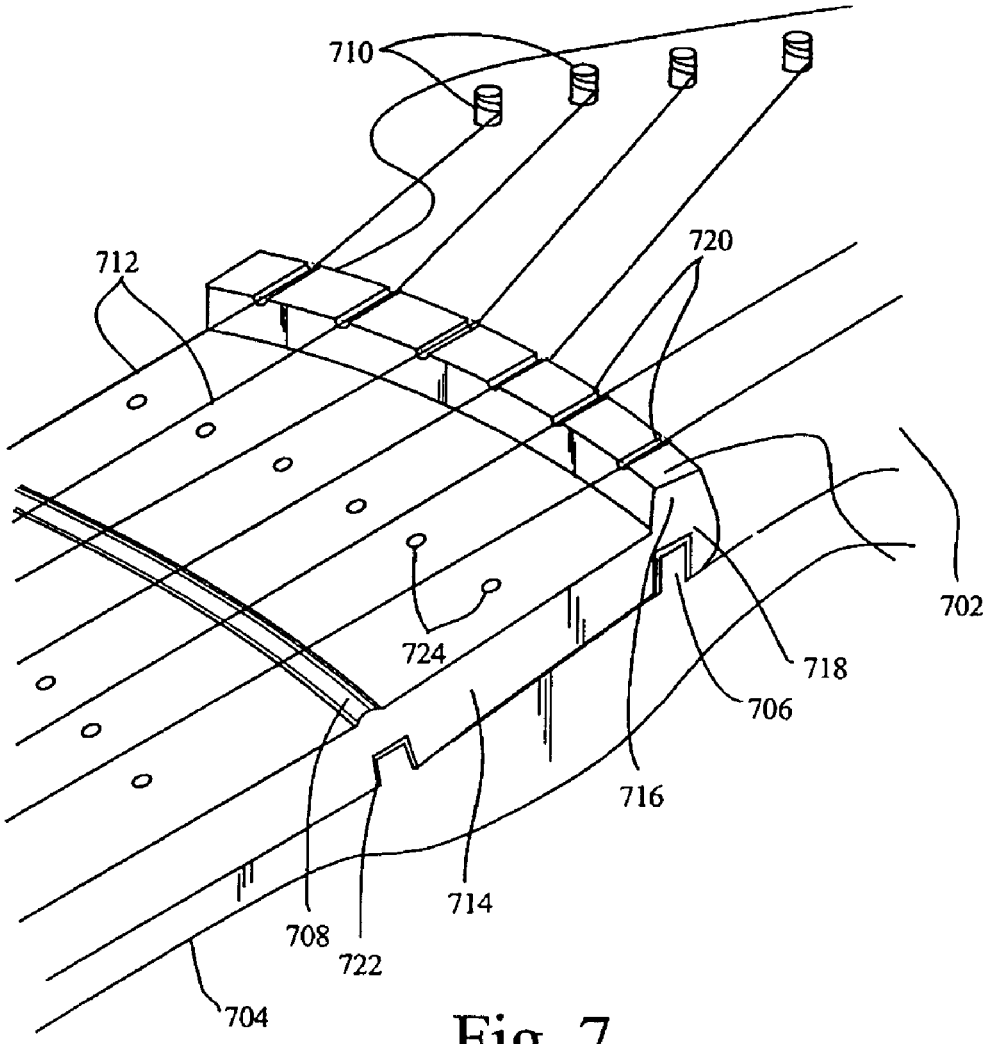
FIG. 7 is an isometric diagram illustrating a portion of a learning aid in accordance with another embodiment.

Referring to FIG. 7 an isometric diagram is shown illustrating a portion of a learning aid in accordance with another embodiment of the present invention. Shown is a head 702 of a stringed instrument, a neck 704 of the stringed instrument, a nut 706, a fret 708, a plurality of tuning bolts 710, a plurality of strings 712, a replacement fret board 714 of the learning aid, an overlapping nut 716, a hook 718, a plurality of string groves 720, a fret relief 722, a replacement fret 724 and a plurality of holes.

Figure 8:
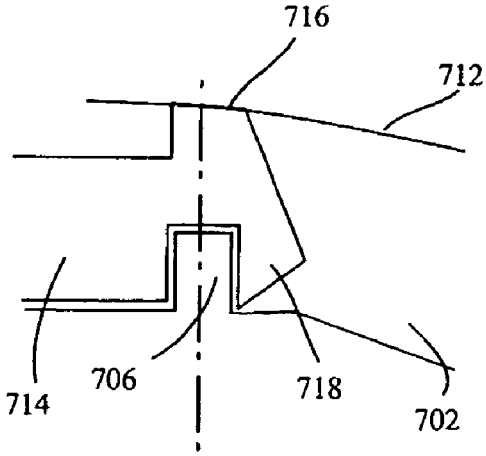
FIG. 8 is a side cross sectional view illustrating a portion of the learning aid of FIG. 7 in accordance with an embodiment.

Referring to FIG. 8 a side cross sectional view is shown illustrating a portion of the learning aid of FIG. 7 in accordance with an embodiment of the present invention. Shown is the head 702 of the stringed instrument, the nut 706, the string 712, the fret plate 714, the overlapping nut 716, and the hook 718.

The learning aid is similar to any of the learning aids described herein, however, the hook 718 is attached to the overlapping nut 716 or molded as part of the overlapping nut 716. In some embodiments described herein, the learning aid has a tendency to move toward the body of the stringed instrument because of the force put on the overlapping nut 716 by the plurality of strings 712. The hook 718 contacts the side of the nut 706 closest the head 702 of the stringed instrument and counteracts the force of the strings 712 on the overlapping nut 716, causing the learning aid to remain in place.

The hook 718 can be either attached to the overlapping nut 716 or be molded as part of the overlapping nut 716. The hook 718 can be many different shapes or sizes and should be strong enough to counteract any force placed on the overlapping nut 716 by the strings 712 without breaking.

Figure 9:
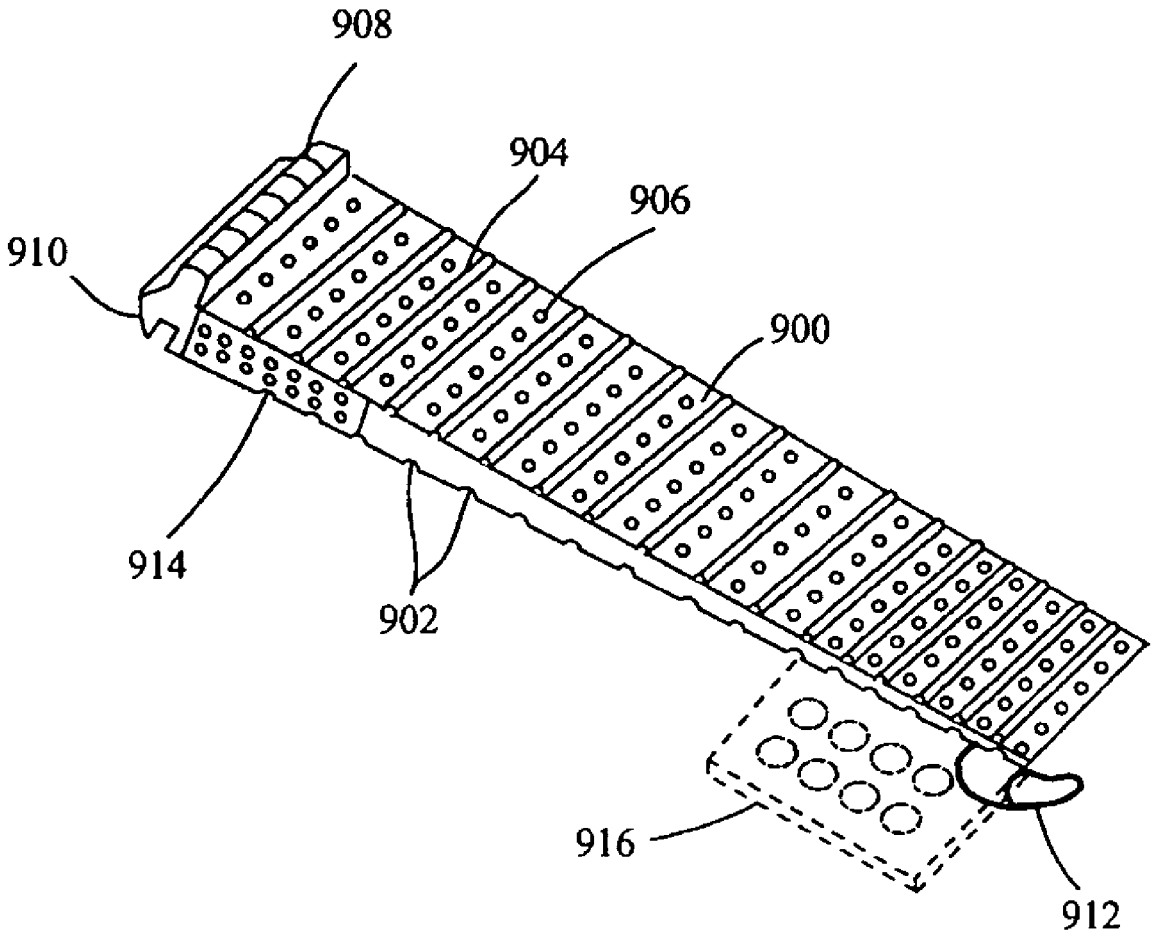
FIG. 9 is an isometric diagram illustrating a learning aid in accordance with an alternative embodiment.

Referring to FIG. 9 an isometric diagram is shown illustrating a learning aid in accordance with an alternative embodiment of the present invention. Show is a replacement fret board 900, a plurality of fret reliefs 902, a plurality of replacement frets 904, a plurality of indicators 906, an overlapping nut 908, a hook 910, an attachment clasp 912, a control panel 914 in a side of the replacement fret board 900, and an alternative control panel 916 located proximate to an attachment clasp 912.

Advantageously, the control panel 914 in the side of the replacement fret board 900 or the alternative control panel 916 does not get in the way of a user of the device. Additionally, either position of the control panel will provide easy access in order to change what is being displayed by the plurality of indicators 906, for example, scales, chords, or lead riffs.

Figure 10:
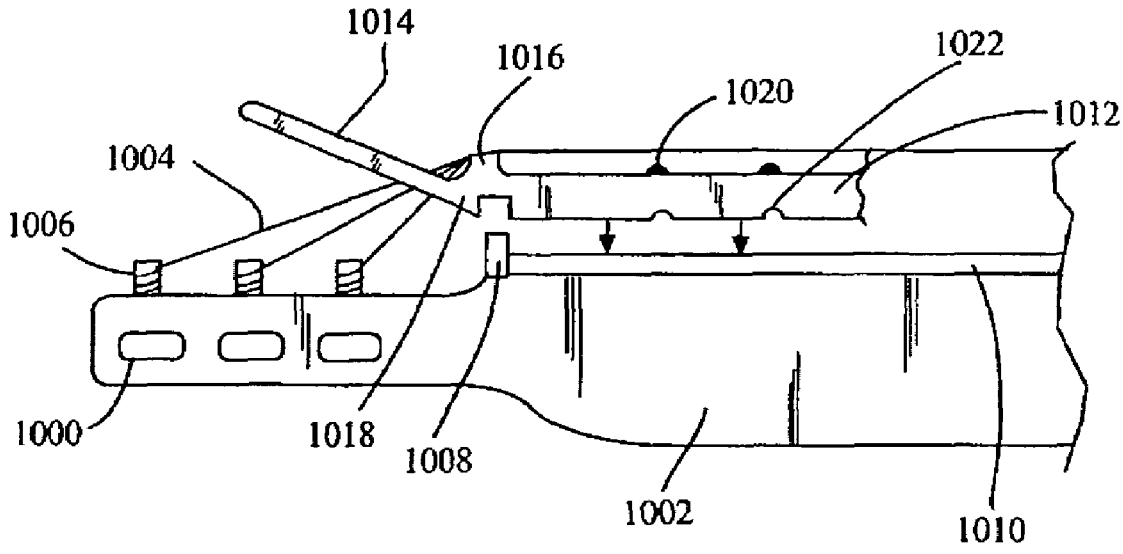
FIG. 10 is an isometric diagram illustrating a learning aid in accordance with yet another alternative embodiment.

Referring to FIG. 10 an isometric diagram is shown illustrating a learning aid in accordance with one yet another alternative embodiment of the present invention. Shown is a head 1000, a neck 1002, a plurality of strings 1004, a plurality of adjustment screws 1006, a nut 1008, a fret board 1010, a replacement fret board 1012, a control panel 1014, a overlapping nut 1016, a hook 1018, a plurality of replacement frets 1020, and a plurality of fret reliefs 1022.

Figure 11:
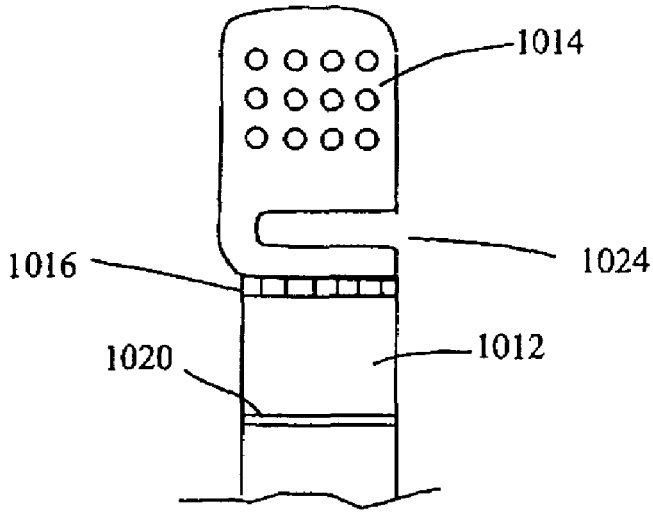
FIG. 11 is a top cross sectional view of a portion of the learning aid of FIG. 10 in accordance with an embodiment.

Referring to FIG. 11 a top cross sectional view is shown illustrating of a portion of the learning aid of FIG. 10 in accordance with an embodiment of the present invention. Shown is the replacement fret board 1012, one of the plurality of replacement frets 1020, the overlapping nut 1016, an opening for strings to pass through 1024, and the control panel 1014.

The replacement fret board 1012 and overlapping nut 1016 are similar to the embodiments described herein. The learning aid, however, includes the control panel 1014 located near the head 1000 of the stringed instrument. This conveniently allows for an easily accessible control panel while keeping the control panel 1014 from interfering with playing the stringed instrument. The opening 1024 is cut away such that the strings 1004 can pass through it without touching part of the control panel 1014, thus, not interfering with the operation of the stringed instrument. As described above, the control panel 1014 can include a replaceable chip or flash card in order to change the operation of the learning aid.

Advantageously, FIGS. 9-11 demonstrate a few of the many different options for the control panel in accordance with the present invention.

Referring to FIG. 12 is an isometric diagram is shown illustrating a replacement bridge in accordance with an embodiment of the present invention. Shown is a body 1200 of a stringed instrument, a plurality of strings 1202, a bridge 1204 of the stringed instrument, and a replacement bridge 1206.

Advantageously, the replacement bridge 1026 provides for a means to lift the strings 1202 away from the body of the stringed instrument similar to the overlapping nut of the learning aid. The replacement bridge 1026 is held in place by the force of the strings and a friction pad where the replacement bridge 1026 contacts the guitar body.

In one embodiment, the fret plate of the learning aid does not have a tapered width (thick to thin, starting from the head down to the body) as the replacement bridge 1206 will lift the strings 1202 at the opposite end of the overlapping nut, thus keeping the strings from interfering with the fret plate.

Referring to FIG. 13 an isometric diagram is shown illustrating another replacement bridge in accordance with an alternative embodiment of the present invention. Shown is a body 1300 of a stringed instrument, a plurality of strings 1302, a bridge of the stringed instrument 1304, a replacement bridge 1306, a replacement fret board 1308 and a plurality of rods 1310.

The replacement fret board 1308 is attached to the plurality of rods 1310 at the end opposite of the overlapping nut (not shown). The plurality of rods 1310 are also attached to the replacement bridge 1306.

The rods 1310 provide a coupling between the replacement fret board 1308 and the replacement bridge 1306. As discussed above with reference to FIG. 7, the strings place a force on the overlapping nut that will force the replacement fret board 1308 toward the body of the stringed instrument. Because the replacement bridge 1306 is coupled to the replacement fret board 1308 through the plurality of rods 1310, the forces will cancel each other out and the replacement fret board will stay in place without then need for a hook on the overlapping nut. In this embodiment, the string force will hold the replacement bridge 1306 in place. The rods 1310 also set the correct scale distance between the replacement nut and the replacement bridge.

The rods 1310 can optionally be retractable or extendable rods or strips that allow accurate fret and scale spacing to the replacement bridge.

Figure 14:
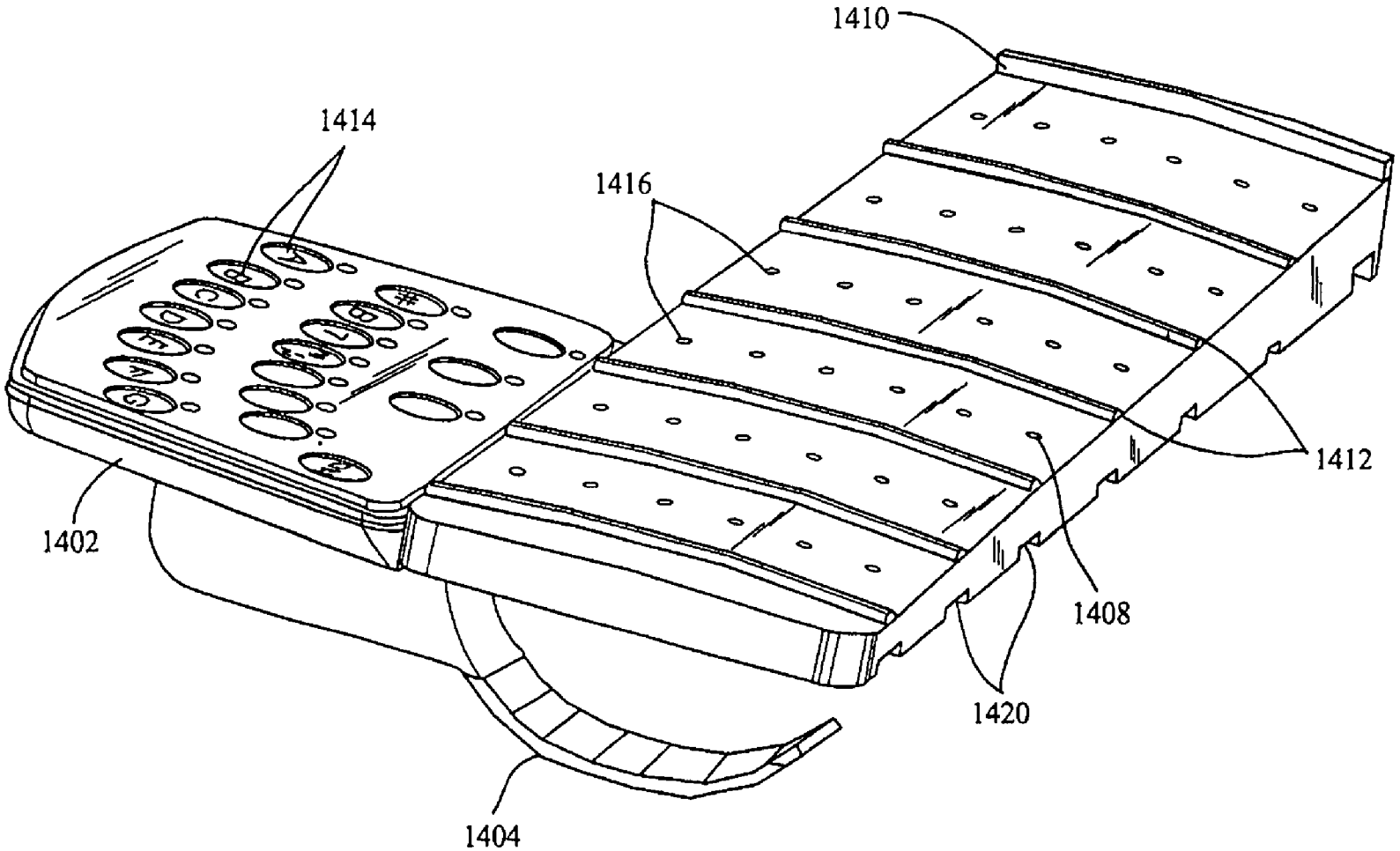
FIG. 14 is an isometric diagram illustrating slightly elevated view of a learning aid in accordance with another embodiment.

Referring to FIG. 14 an isometric diagram is shown illustrating slightly elevated view of a learning aid in accordance with another embodiment. Shown is a control unit 1402, an attachment clasp 1404, a replacement fret board 1408, an overlapping nut 1410, a plurality of replacement frets 1412, a plurality of fret reliefs 1420, a plurality of input buttons 1414 and a plurality of holes 1416 in the replacement fret board.

The control unit 1402 is coupled to the attachment clasp 1404 and the replacement fret board 1408. The position of the control unit 1402 is such that it will not greatly interfere with a user playing a musical instrument while using the learning aid. The control unit 1402 includes the plurality of input buttons 1414. The plurality of input button 1414 includes note buttons, key buttons and mode buttons. The attachment clasp 1404 secures the learning aid to a stringed instrument (not shown). As described above, the learning aid also is held in place by the tension of the strings of the stringed instrument. In the present embodiment the plurality of fret reliefs 1420 are wider than those shown and described above with reference to FIGS. 1-8. This allows for the learning aid to be used with a variety of different stringed instruments while accommodating shifting of the learning aid to different scales.

The learning aid shown in FIG. 14 includes six frets. Alternative embodiments include more or less frets. More frets are preferably used by more advanced players, while the six fret learning aid is used by more beginner players.

The control unit 1402 is electrically coupled to a plurality of indicators (not shown). As described above, the plurality of indicators are preferably LED's. The LED's are located beneath the plurality of holes 1416. The control unit 1402 selectively turns the LED's on and off, indicating which strings are to be depressed by the user. In this manner, the user learns to play different songs, chords and scales. More generally, the user learns to play the stringed instrument.

In one embodiment, the control unit stores information relating to one or more songs. The information controls which strings are to be depressed by the user, thus, enabling the user to replicate the song on the stringed instrument.

Figure 15:
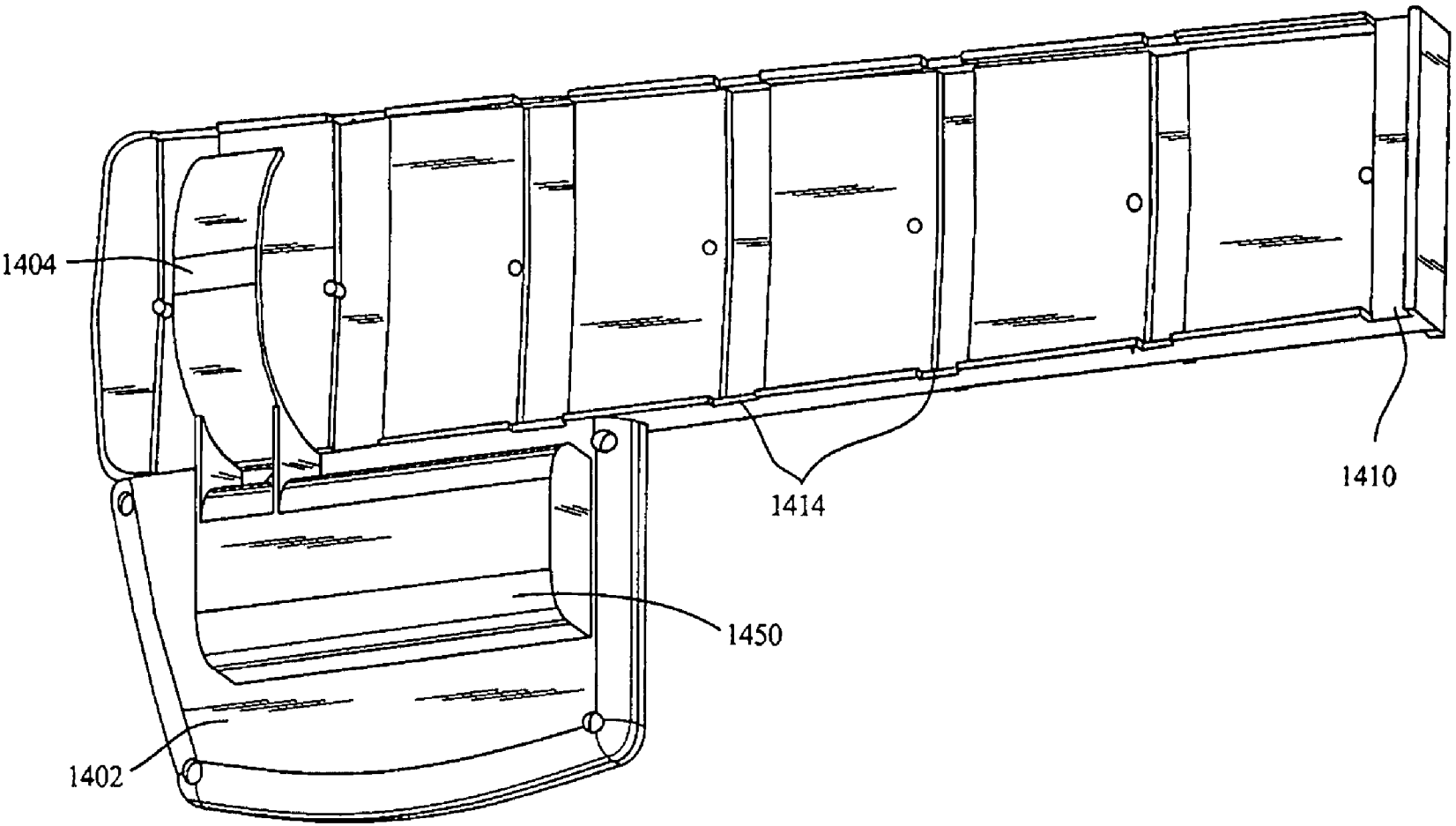
FIG. 15 is an isometric diagram illustrating a bottom view of the learning aid of FIG. 14.

Referring to FIG. 15 an isometric diagram is shown illustrating a bottom view of the learning aid of FIG. 14. Shown is the control unit 1402, the attachment clasp 1404, the overlapping nut 1410, the plurality of fret reliefs 1420, and a battery package 1450. The battery package 1450 holds two AA batteries in one embodiment. The batteries provide power for the control unit 1402 and the plurality of indicators (not shown). Alternatively, the control unit 1402 and the plurality of indicators are powered through power from an AC outlet, utilizing a AC to DC converter. Still alternatively, the learning aid can be powered primarily from an AC outlet while utilizing the batteries as backup power.

Figure 16:
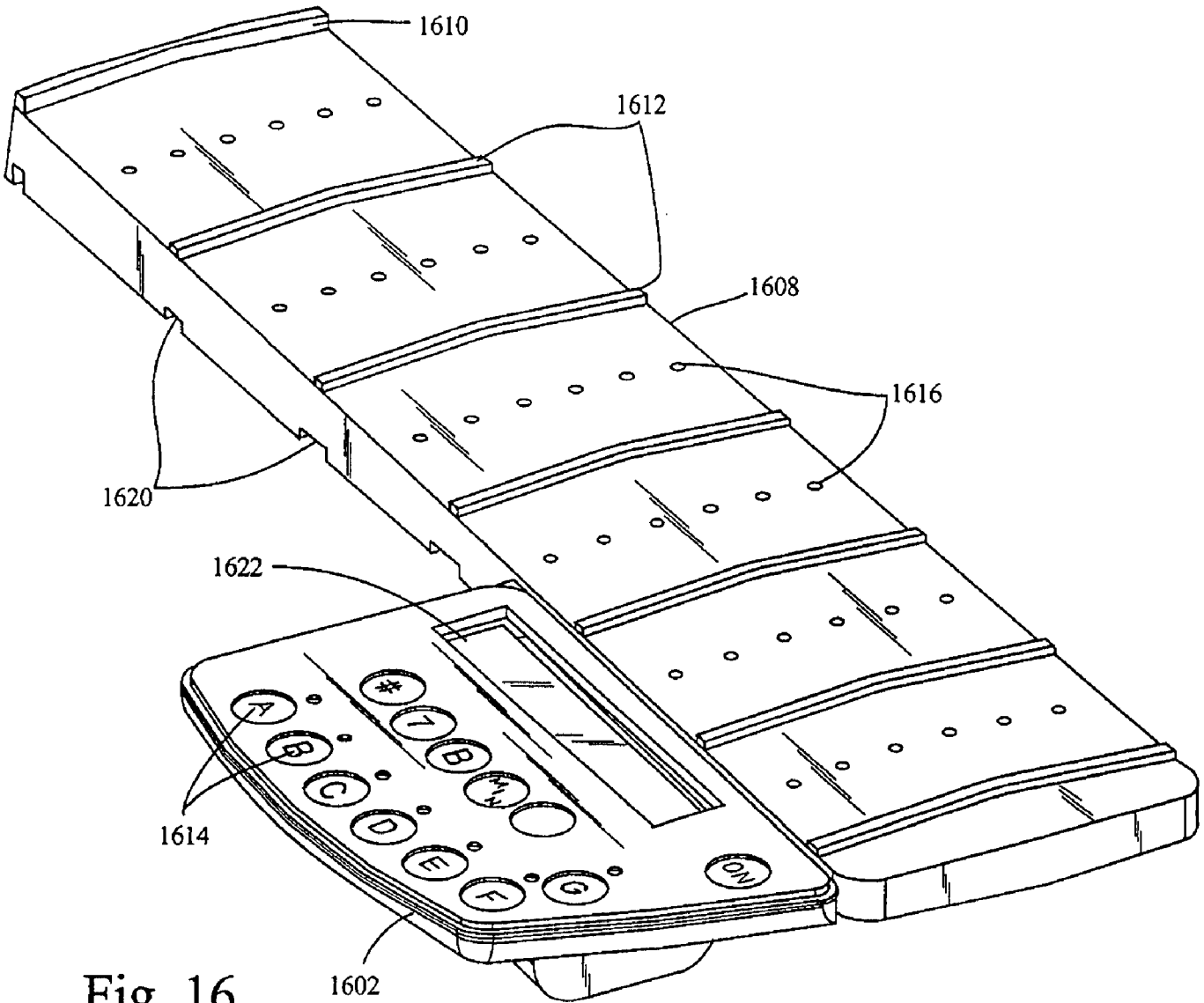
FIG. 16 is an isometric diagram illustrating an alternative embodiment of a learning aid in accordance with one embodiment.

Referring to FIG. 16 an isometric diagram is shown illustrating an alternative embodiment of a learning aid according to one embodiment. Shown is a control unit 1602, a replacement fret board 1608, an overlapping nut 1610, a plurality of replacement frets 1612, a plurality of fret reliefs 1620, a plurality of input buttons 1614, a display screen 1622 and a plurality of holes 1616 in the replacement fret board.

The embodiment shown is similar to the embodiment described above with reference to FIG. 14, however, the display screen 1622 has been added to the control unit 1602. The display screen 1622 is in one embodiment a liquid crystal display (LCD) screen. Alternative types of display screen are also optionally used. The display screen 1622 is utilized to display, for example, the song, scale or chord that is being output to a plurality of indicators. For example, if the plurality of indicators are displaying the strings to be depressed to play a scale in A minor, the display screen will read "A minor."

Figure 17:
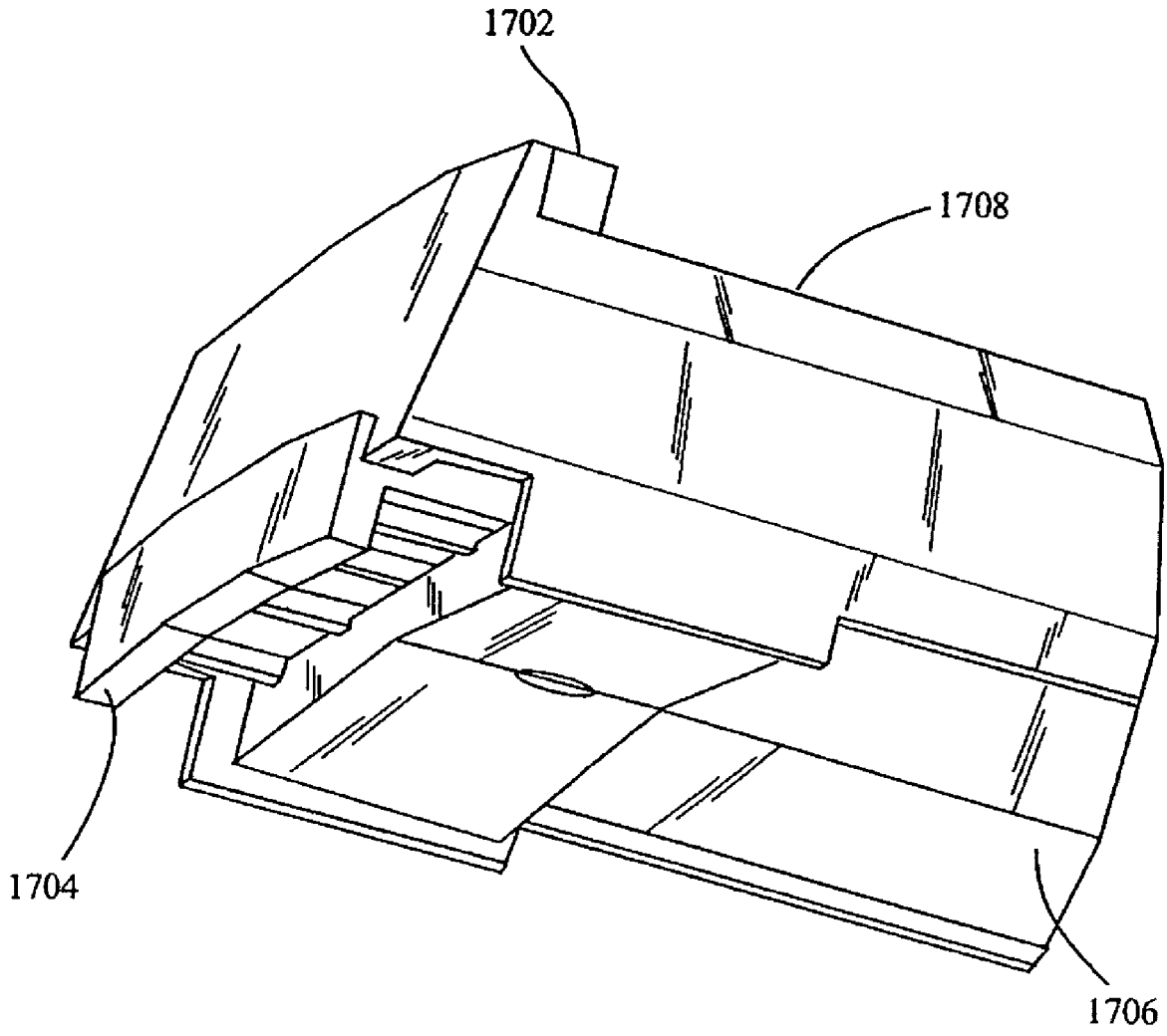
FIG. 17 is an isometric diagram illustrating a slightly lowered view of a portion of a learning aid in accordance with an alternative embodiment.

Referring to FIG. 17 an isometric diagram is shown illustrating a slightly lowered view of a portion of a learning aid in accordance with an alternative embodiment. Shown is a replacement nut 1702, an overlapping nut slider 1704, a support board 1706 and a fret plate 1708.

The overlapping nut slider 1704 is movably coupled to the fret plate 1708 and the support board 1706. The overlapping nut slider 1704 adjusts such that the learning aid can be used with many different stringed instruments as long as the stringed instrument has the same or longer scale than the learning aid. The overlapping nut slider 1704 (also referred to herein as the slider 1704) allows the learning aid to be place on different sized scales (e.g., 24.75", 25.5") while being able to stay in tune from one note to the next. The overlapping nut slider 1704 adjusts and determines how the fret plate sits on the stringed instrument in relation to the nut of the stringed instrument. The slider 1704 is one example of an adjustment device for adjusting the distance between the replacement nut 1702 and a bridge of a stringed instrument such that a proper tune of the instrument is maintained while using the learning aid. Other adjustment devices and means for adjusting the distance between the replacement nut 1702 are utilized in alternative embodiments.

In one embodiment, graphics are provided on a top of the slider 1704 can indicate to the user how far it must be extended for the particular instrument the learning aid is being used with. Alternatively, an adjustable thumbscrew can be used to set the proper distance from the existing nut. Still alternatively, an oblong lever or a separate measuring device (e.g., a wire, a paper measuring unit, a rule) can set the proper distance.

The slider 1704 places the fret plate the correct distance from the bridge of a stringed instrument such that the instrument is in proper tune.

Figure 18:
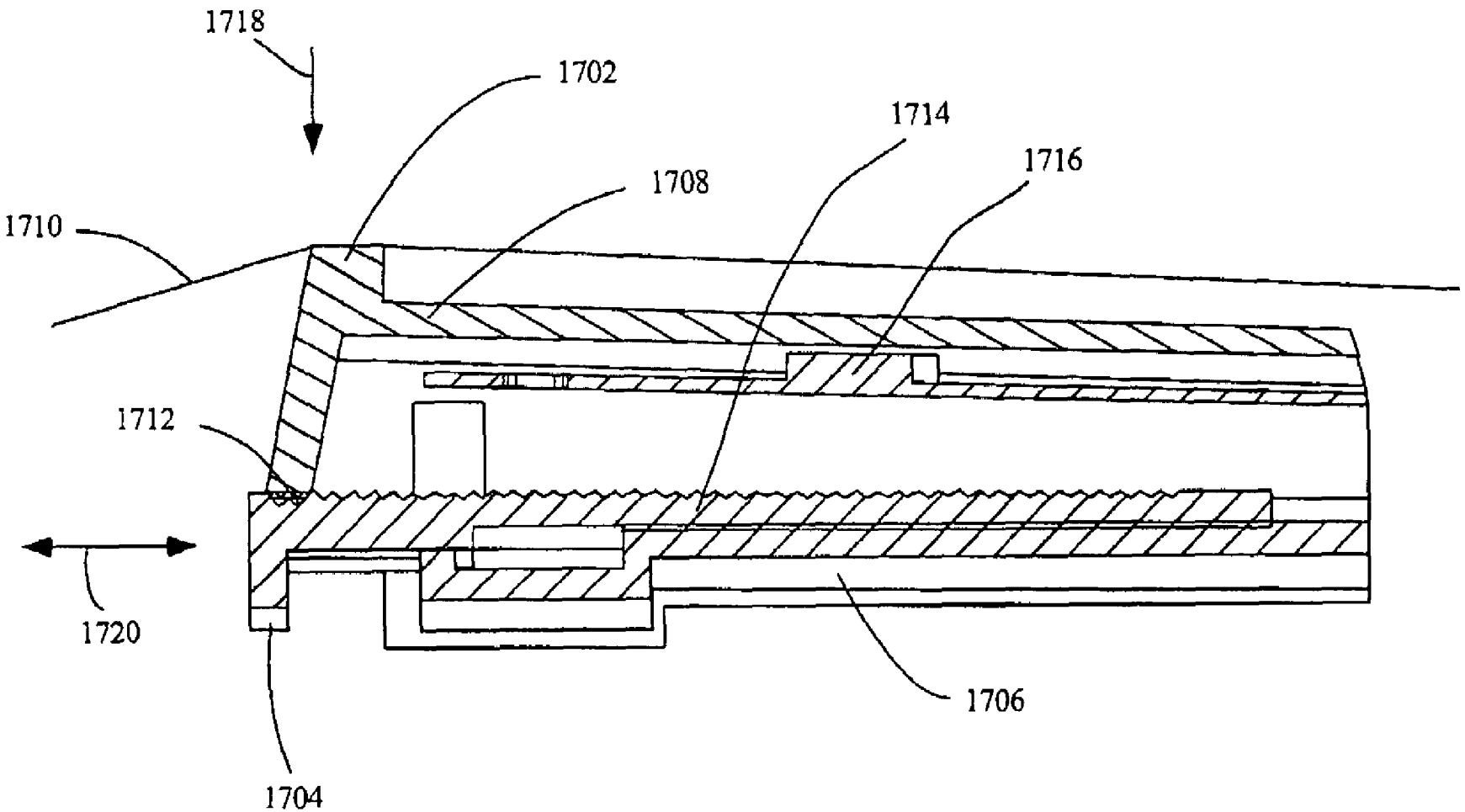
FIG. 18 is a side cross sectional view of the learning aid of FIG. 17.

Referring to FIG. 18 is a side cross sectional view of the learning aid of FIG. 17. Shown is the replacement nut 1702, the overlapping nut slider 1704, the support board 1706, the fret plate 1708, a string 1710, fret plate teeth 1712, nut slider teeth 1714, a circuit board 1716, a string force direction arrow 1718, and a slider movement of direction arrow 1720.

The overlapping nut slider 1704 moves in and out of the learning aid in the as indicated by the slider movement of direction arrow 1720. The overlapping nut slider 1704 provides one exemplary means for adjusting the distance from the replacement nut 1702 and a bridge of a stringed instrument. When the learning aid is place on the stringed instrument, the overlapping nut slider can be adjusted to the proper distance (such as described above with reference to FIG. 17. The strings of the stringed instrument are then tightened, thus exerting a force which is indicated by the string force direction arrow 1718. The force causes the fret plate teeth 1712 to engage the nut slider teeth 1714, thus preventing the overlapping nut slider 1704 from moving while the learning aid is in use.

While the invention herein disclosed has been described by means of specific embodiments and applications thereof, other modifications, variations, and arrangements of the present invention may be made in accordance with the above teachings other than as specifically described to practice the invention within the spirit and scope defined by the following claims.

What I claim is:

1. An apparatus for a stringed instrument comprising:

a replacement fret board for non-intrusive placement over an existing fret board comprising:

a fret plate having a top end and a bottom end and including an integral overlapping replacement nut, the integral overlapping replacement nut capable of at least partially surrounding an existing nut, the fret plate having a varying thickness along the longitudinal length of a main axis connecting the top end and the bottom end, the thickness decreasing lengthwise from a first thickness at the first end of the fret plate to a second thickness at the second end of the fret plate; and a support board including fret relief notches coupled to the fret plate, the fret relief notches configured and arranged to fit over existing frets of the instrument; and an attachment member coupled to the replacement fret board for securing the fret board device to the stringed instrument.

2. An apparatus of claim 1 further comprising a circuit board coupled to the fret plate.

3. An apparatus of claim 2 further comprising a controller electronically coupled to the circuit board.

4. The apparatus of claim 1 wherein the integral overlapping replacement nut includes a plurality of groves for holding in place a plurality of strings of the stringed instrument.

5. The apparatus of claim 1 wherein the integral overlapping replacement nut includes a hook.

6. The apparatus of claim 1 wherein the fret plate includes a plurality of replacement frets.

7. The apparatus of claim 6 wherein the fret plate includes a plurality of lights in between the plurality of replacement frets.

8. The apparatus of claim 1 further comprising an overlapping nut slider for measuring where to position the fret board.

9. A learning apparatus for a stringed instrument comprising:

a replacement fret board comprising an integral overlapping replacement nut and designed to non-intrusively rest between an existing fret board and a plurality of strings of the stringed instrument, wherein the integral overlapping replacement nut is capable of at least partially surrounding an existing nut, the fret board having a top end and a bottom end and having a varying thickness along the longitudinal length of a main axis connecting the top end and the bottom end, the thickness decreasing lengthwise from a first thickness at the first end of the fret board to a second thickness at the second end of the fret board;

means for controlling an indicator coupled to the replacement fret board;

wherein said indicator displays which of the plurality of strings of the stringed instrument is to be played.

10. The apparatus of claim 9 further comprising an attachment member coupled to the replacement fret board for securing the plate to the stringed instrument.

11. The apparatus of claim 9 wherein a bottom of the replacement fret board includes a plurality of fret reliefs.

12. The apparatus of claim 9 wherein a top of the replacement fret board includes a plurality of replacement frets.

13. The apparatus of claim 12 wherein the integral overlapping replacement nut includes a hook to hold the plate in place over an existing nut of the stringed instrument.

14. A finger guide plate comprising:

a fret plate non-intrusively positioned over an existing fret board, the fret plate having a top end and a bottom end and having a varying thickness along the longitudinal length of a main axis connecting the top end and the bottom end, the thickness decreasing lengthwise from a first thickness at the first end of the fret plate to a second thickness at the second end of the fret plate and including an integral overlapping replacement nut, the integral overlapping replacement nut raising strings of the instrument above an original position and being capable of at least partially surrounding an existing nut;

a circuit board coupled to the fret plate; and means for indicating the strings to be played on a stringed instrument coupled to the circuit board.

15. The apparatus of claim 14 further comprising a replacement bridge coupled to a bridge of the stringed instrument.

16. The apparatus of claim 15 further comprises means for coupling the replacement bridge to the replacement fret board.

17. The finger guide plate of claim 14 further comprising a support plate coupled to a bottom of the circuit board.

18. The finger guide plate of claim 14 further comprising a support plate coupled to the fret plate and a plurality of fret relief slots in a bottom of the support plate.

19. The finger guide plate of claim 14 further comprising an attachment clip coupled to the fret plate for securing the finger guide plate to a stringed instrument.

20. The finger guide plate of claim 14 wherein the integral overlapping replacement nut includes a plurality of groves for holding in place the strings of the stringed instrument.

21. The finger guide plate of claim 20 wherein the integral overlapping replacement nut includes a hook.

22. The finger guide plate of claim 14 wherein said means for indicating strings to be played on a stringed instrument are adapted to indicate the root notes of a scale.

23. The finger guide plate of claim 22 wherein the root notes of a scale are indicated by a difference in color of the means for indicating or a difference in brightness of the means for indicating.

* * * * *